United States Patent [19]

Nash

[11] 4,064,691

[45] Dec. 27, 1977

[54] COOLING OF FASTENER MEANS FOR A REMOVABLE FLAMEHOLDER

[75] Inventor: Dudley O. Nash, Cincinnati, Ohio

[73] Assignee: General Electric Company, Cincinnati, Ohio

[21] Appl. No.: 628,749

[22] Filed: Nov. 4, 1975

[51] Int. Cl.[2] ..... F02C 7/22

[52] U.S. Cl. ..... 60/39.06; 60/39.66; 60/39.72 R; 60/261; 60/266

[58] Field of Search ..... 60/39.72 R, 39.72 P, 60/39.66, 261, 224, 266, 267, 39.06

[56] References Cited

U.S. PATENT DOCUMENTS

| | | | |
|---|---|---|---|
| 3,102,392 | 9/1963 | Bauger et al. | 60/39.72 R |
| 3,151,453 | 10/1964 | Lefebvre et al. | 60/39.72 R |
| 3,236,048 | 2/1966 | Spears | 60/261 |
| 3,315,468 | 4/1967 | Vdoviak | 60/39.72 R |
| 3,587,232 | 6/1971 | Bryce | 60/261 |
| 3,698,186 | 10/1972 | Beane et al. | 60/261 |
| 3,765,178 | 10/1973 | Hufnagel et al. | 60/39.72 R |
| 3,932,988 | 1/1976 | Beaufrere | 60/39.71 |

*Primary Examiner*—Robert E. Garrett
*Attorney, Agent, or Firm*—Robert C. Lampe, Jr.; Derek P. Lawrence

[57] ABSTRACT

A flameholder apparatus for use in a gas turbine engine exhaust nozzle comprises at least one V-shaped gutter for holding a flame, with fasteners to mount the gutter to a nozzle support structure, the fasteners being accessible from the downstream flow direction and protruding into the gutter. To prevent the fasteners from overheating, the protruding portion is recessed in a heat shield affixed to the gutter and a portion of the combustible nozzle gas stream is passed into the heat shield and over the fastener at a velocity at least as great as the flame propagating velocity. In one embodiment, the gutter is segmented to facilitate removal through a smaller nozzle opening. Alignment pins between adjacent gutter segments provide proper gutter segment orientation, while adjacent segments are attached together through cooperating flanges on the upstream surfaces of the segments to minimize flow blockage pressure losses.

7 Claims, 8 Drawing Figures

Fig 1
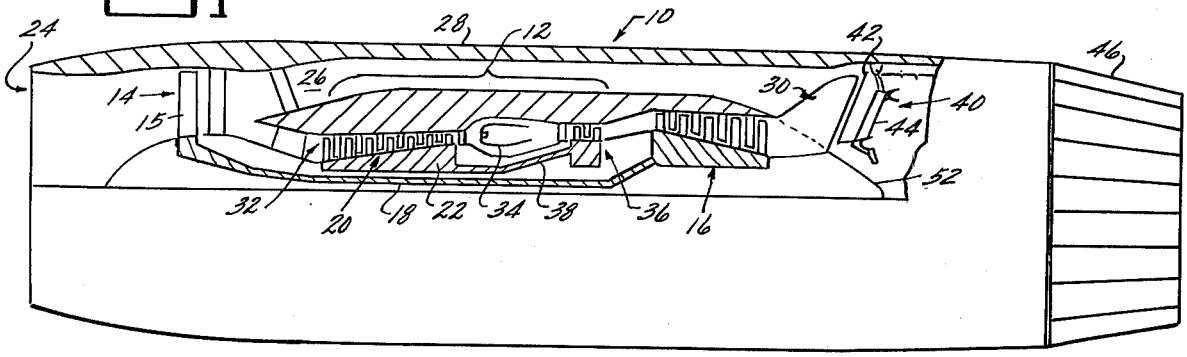
Fig 2
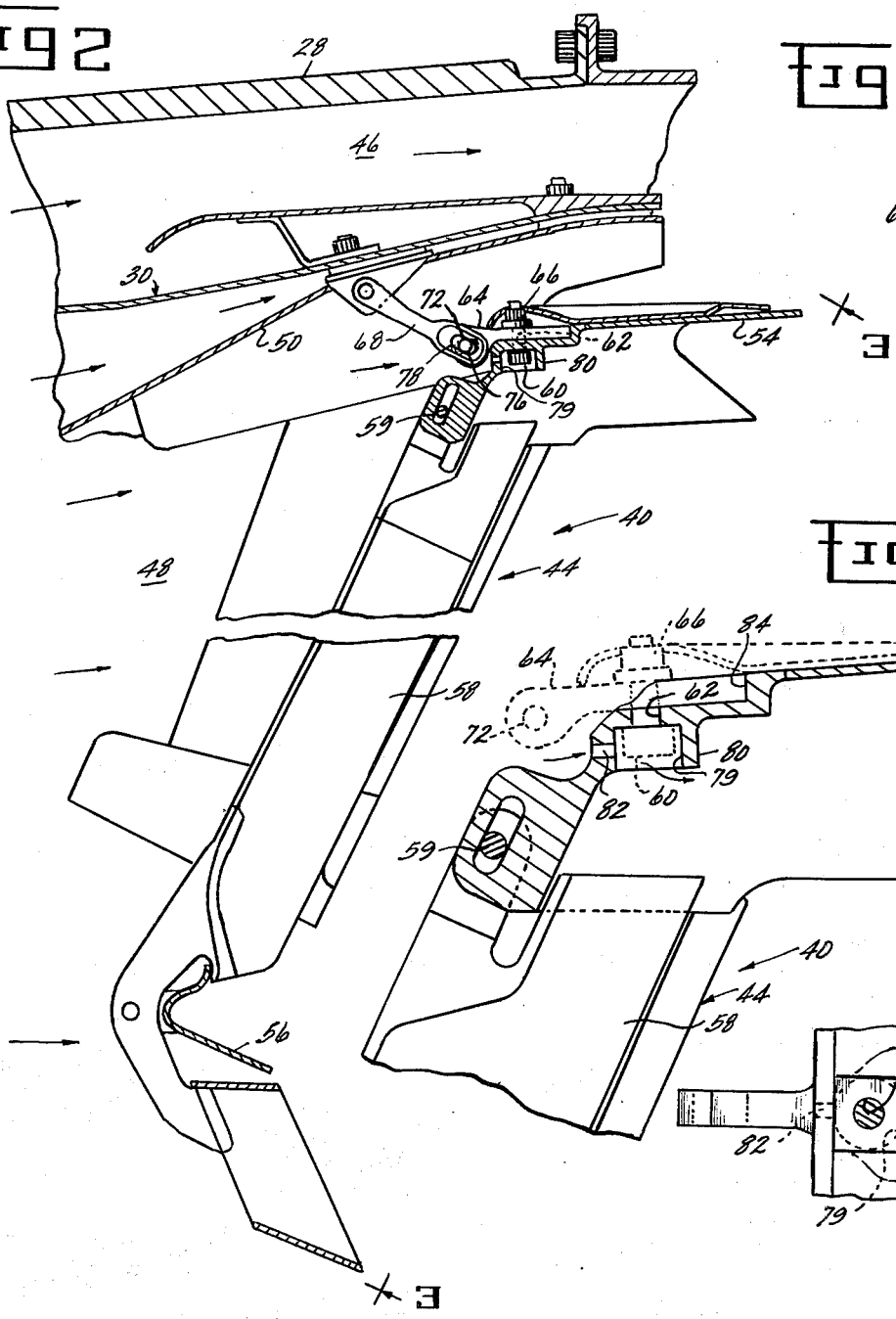
Fig 8
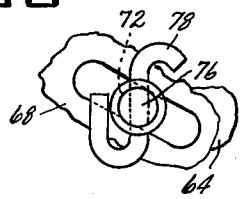
Fig 4
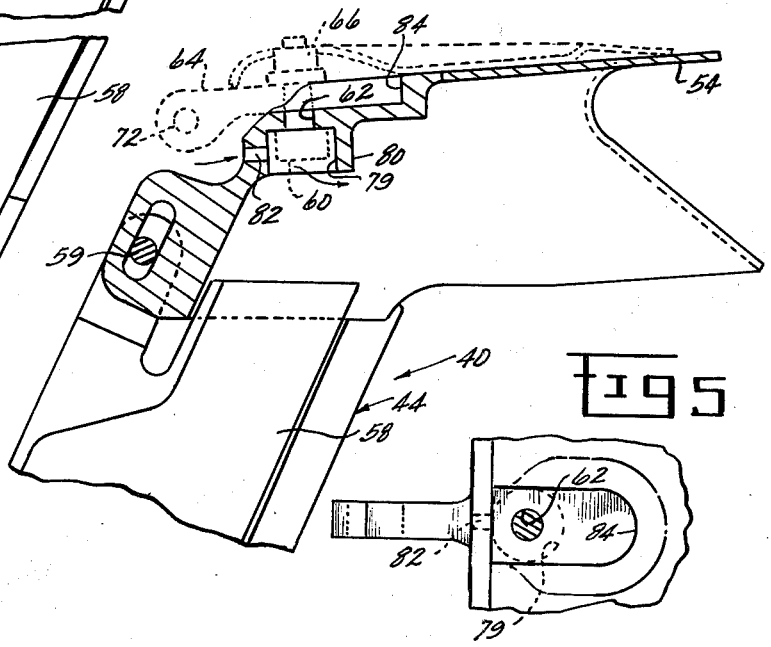
Fig 5

28
30
46
50
68
76
54
78
64
86
6
6
40
52
52
48
48
58
44
92
54
92
88
54
90
88
86
92
54
58
58
86
56

COOLING OF FASTENER MEANS FOR A REMOVABLE FLAMEHOLDER

BACKGROUND OF THE INVENTION

The present invention relates to gas turbine engines having afterburners and, more particularly, to a removable flameholder for use therein.

The invention herein described was made in the course of or under a contract, or a subcontract thereunder, with the United States Department of the Air Force.

Modern gas turbine engines for fighter aircraft application utilize afterburners (or augmenters) to augment the energy level of the hot gas stream exhausted from the engine nozzle, thus increasing the thrust level. In such augmenters, fuel is injected into a hot gas stream and ignited. Flameholders mounted downstream of the injectors establish a stable flame front or localized combustion zone for the augmenting fuel.

V-shaped sheet metal gutters have been found to be effective as flameholders, the apex of each gutter being oriented in an upstream direction toward the fuel injectors. These flameholders necessarily operate at very high temperatures and are among the shorter life components of a gas turbine engine. Therefore, it is especially desirable that these parts be easily installed and removed without removal of the engine from the aircraft or removal of the augmenter, or exhaust nozzle, from the engine.

Fan engines with mixed flow augmenters are generally equipped with multilobe mixers to comingle the hot core engine exhaust gases with the relatively cooler fan exhaust gases, and the flameholder is mounted within this mixer at its downstream end. Typically, the mixer envelopes the flameholder resulting in very difficult access to the fasteners attaching the flameholder to the remaining fixed nozzle structure; heretofore the fasteners had to be shielded from the extremely hot afterburning gases and were normally located on the back side (upstream side) of the gutter. Assembly and removal of this type of flameholder with twenty or more (for example) such inaccessible fasteners were extremely difficult, time consuming and costly. This method has been used for many years, however, since it was believed that any fastener accessible from inside the gutter would be overheated. Such fasteners located inside the gutters have, in fact, been tried and have melted. A simple means of mounting flameholders in mixed flow augmenters, therefore, is a needed improvement.

In order that high augmenter performance can be achieved, the flameholder diameter is often larger than the exhaust nozzle diameter. This means that the flameholder cannot be removed and replaced through the exhaust nozzle, thus requiring that the engine be removed from the aircraft and the entire augmenter removed in order to replace the flameholders. This is a time-consuming, costly maintenance procedure. Thus, simple means are needed for removing the flameholder through the exhaust nozzle.

SUMMARY OF THE INVENTION

Accordingly, it is the primary object of the present invention to provide an easily removable flameholder wherein all mounting hardware is protected from the intense heat generated by the augmenter.

It is a further object of the present invention to provide an improved and simple means for removing the flameholder through its associated exhaust nozzle.

It is yet another object of the present invention to provide a method for cooling a fastener connecting a flameholder gutter to nozzle support structure when the fastener protrudes into the gutter.

These and other objects and advantages will be more clearly understood from the following detailed description, drawings and specific examples, all of which are intended to be typical of rather than in any way limiting to the scope of the present invention.

Briefly stated, the above objects are accomplished by providing an augmenter with at least one generally V-shaped gutter for holding and stabilizing a flame. Fasteners passing through the gutter attach the gutter to a nozzle-supporting member. In order to protect the fastener from the intense heat generated inside the gutter, the fastener is recessed in a heat shield affixed to the inside of the gutter, thus limiting the fastener heating flux. In addition, the fastener is cooled by combustible gas passing through an aperture communicating the upstream gas flow with the interior of the heat shield. Since the augmenter fuel injectors are well upstream of the gutter, this coolant flow is carbureted and it might be expected that such a combustible mixture would ignite as it flowed through the aperture and into the heat shield, thus overheating the fastener. In fact, in the present invention, just the opposite occurs since the aperture and heat shield are so sized that the coolant velocity is sufficient to prevent flame propagation upstream to the fastener. Such a design allows very rapid installation and removal of the flameholder since the fasteners can be accessible from the downstream direction.

In order that the flameholder can be removed through the exhaust nozzle for rapid replacement, it is constructed in segments (i.e., circumferential segments when the gutter is substantially annular). The segments are provided with upstream protruding flanges such that the cooperating flanges of adjacent segments can be connected by a connector means such as a nut and bolt (example). In order that flow blockage pressure losses are minimized, the connector is on the upstream side of the gutter. To prevent two adjacent segments from becoming misaligned, alignment pins are provided between such segments.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiment which is given by way of example with the accompanying drawings, in which:

FIG. 1 diagrammatically depicts in partial cut-away an augmented gas turbine engine incorporating the subject invention;

FIG. 2 is an enlarged schematic view of the flameholder of the engine of FIG. 1 depicting in greater detail the subject invention;

FIG. 4 is a further enlarged view showing the flameholder support structure;

FIG. 5 is a top view of the support structure of FIG. 4;

FIG. 8 is an enlarged fragmentary view of the structure of FIG. 2.

DESCRIPTION OF THE PREFERRED EMBODIMENT

Figures 3, 6, 7:
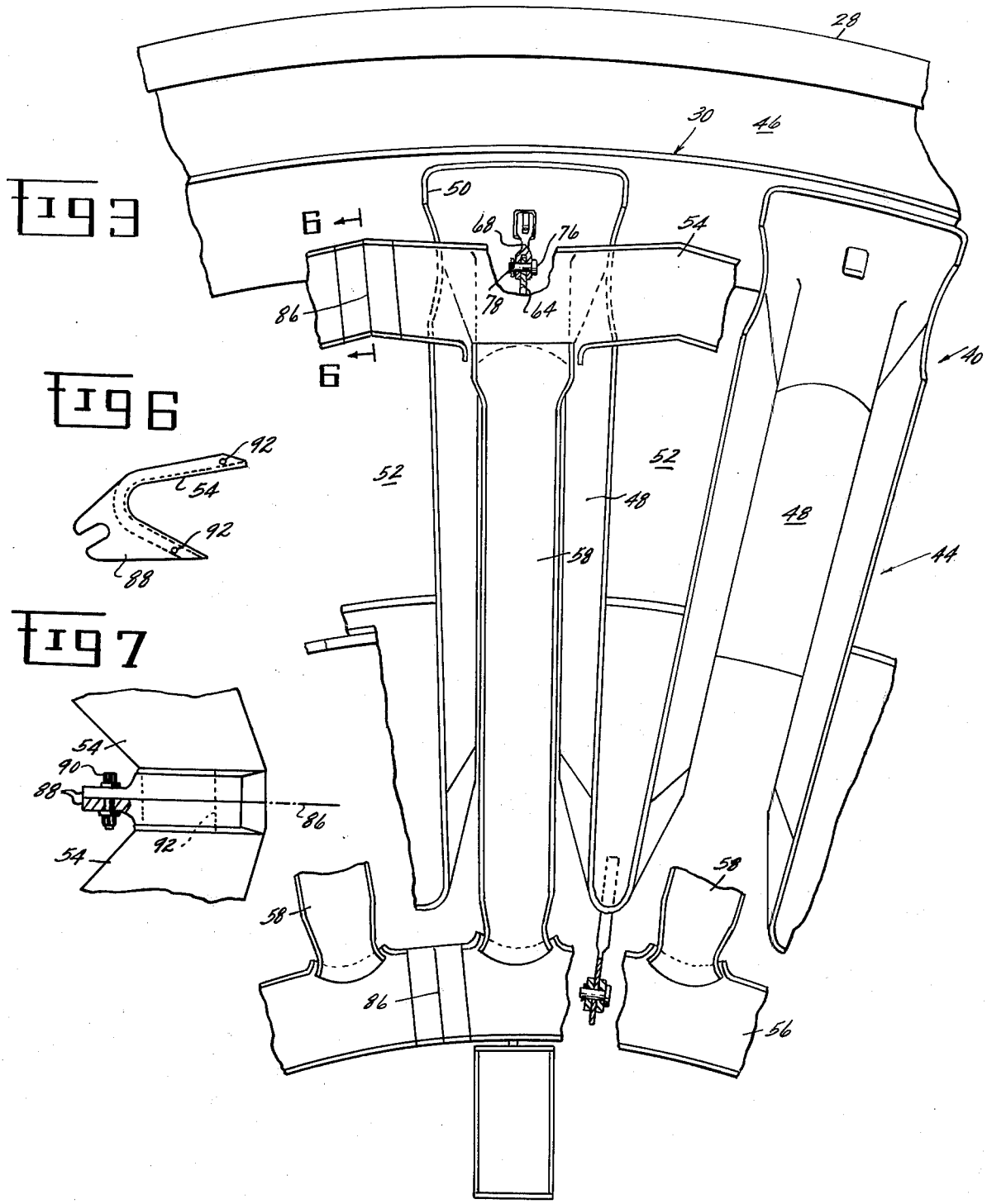
FIG. 3 is a circumferential section of the flameholder taken along line 3—3 of FIG. 2.
FIG. 6 is a fragmentary view of the pin connection between adjacent flameholder segments taken along line 6—6 of FIG. 3.
FIG. 7 is a fragmentary top view of the structure of FIG. 6.

Referring to the drawings wherein like numerals correspond to like elements throughout, reference is first directed to FIG. 1 wherein an engine depicted generally at 10 and embodying the present invention is diagrammatically shown. This engine may be considered as comprising generally a core engine 12, a fan assembly 14, including a stage of fan blades 15 and a fan turbine 16 which is interconnected to the fan assembly 14 by shaft 18. The core engine 12 includes an axial flow compressor 20 having a rotor 22. Air enters inlet 24 and is initially compressed by fan assembly 14. A first portion of this compressed air enters the fan bypass duct 26 defined, in part, by core engine 12 and a circumscribing fan nacelle 28 and discharges through a chuted mixer 30. A second portion of the compressed air enters inlet 32, is further compressed by the axial flow compressor 20, and then is discharged to a combustor 34 where fuel is burned to provide high energy combustion gases which drive a turbine 36. The turbine 36, in turn, drives the rotor 22 through a shaft 38 in the usual manner of a gas turbine engine. The hot gases of combustion then pass to and drive the fan turbine 16 which, in turn, drives the fan assembly 14. The combustion gases from the core engine, after exiting fan turbine 16, are discharged through the chuted mixer 30 where they are comingled with the air from bypass duct 26 in the known manner.

The engine of FIG. 1 is also shown to include an augmenter indicated generally at 40. The augmenter is shown to include at least one fuel injector 42 disposed upstream of a flameholder 44. Fuel injector 42 injects fuel into the gas stream upstream of the flameholder, the fuel becoming carbureted by the time it reaches the flameholder 44 where it is ignited and stabilized. The gases of combustion then pass to, and are discharged from, nozzle 46 to produce a propulsive force to the left in FIG. 1.

Referring now to FIGS. 2 and 3, there is depicted therein an enlarged view of the flameholder and nozzle structure of FIG. 1. It will be noted that a double annular flow path is shown, with a first duct 46 defined by nacelle 28 and chuted mixer 30 which serves to pass a limited portion of the bypass duct (26 in FIG. 1) flow around the mixer for purposes not relevant to the present discussion. The inner annular flow path 48 carrying the carbureted gas stream to the flameholder 44 is defined by the rigid mixer wall 50 and a central plug 52 (FIG. 1). As best shown in FIG. 3, the mixer is of the known "daisy" or chuted type which comingles alternating streams of core engine and fan gases, 48 and 52, respectively.

The flameholder includes an outer annular V-shaped gutter 54, preferably formed of sheet metal and having its apex pointed upstream relative to the combustible gas stream direction. An inner, coannular, V-shaped gutter 56 is located inwardly of gutter 54 and a plurality of radial gutters 58 extend therebetween. As can best be seen in FIG. 4, a slip joint 59 is provided to permit thermal expansion between the circumferential gutter 54 and radial gutters 58. These gutters provide a stabilized combustion zone for the carbureted mixture which is ignited by means not shown. Thus, in operation, a stabilized flame front is formed in the plane of the flameholder to ignite the carbureted gas mixture generated further upstream, significantly increasing the propulsive thrust.

The flameholder 44 is mounted to a supporting member, here mixer 30, by a means now to be described and which comprises, in part, the subject of the present invention. Referring primarily to FIGS. 2 and 4, there is depicted a relatively simple flameholder mounting or fastening means comprising a threaded bolt 60 passing through cooperating bolt holes 62 in the outer V-gutter 54 and a lug 64, the function of which will be described later. Nute 66 completes the connection of the gutter and the lug. Lug 64, in turn, is operatively connected to the rigid mixture structure 30 by means of a hinged link 68. A hole at 72 receives pin 76 passing through lug 64 and the pin, in turn, is captured by means of cotter pins or, as shown at 78, an S-shaped fastener passing therethrough (FIG. 8). This hinged link arrangement retains the flameholder while still permitting relative thermal expansion between the flameholder and the mixer 30. It will be recognized that such a provision is necessary since the mixer receives relatively cool fan air in alternating chutes while the flameholder serves to stabilize the extremely hot, augmenting flame front.

Upon first consideration, it may appear that the foregoing is so straightforward that it would present no advancement over the prior art. However, such an arrangement has not heretofore been adopted because there was no way to protect the head of bolts 60 from the intense heat inside the gutters. Therefore, in the past, lug 64 was formed integral with gutter 54 and the removal procedure for the flameholder consisted of disconnecting the link 68 from the lug 64 by removing S-shaped fastener 78. It becomes readily apparent from FIGS. 2 and 3 that since the mixer structure 30 envelopes the flameholder, access to fasteners 78 from the downstream direction (from the right in FIG. 2) is very difficult at best. Assembly and removal of this type of flameholder with twenty or more inaccessible fasteners (for example) was difficult, time consuming and costly. However, as previously noted, it was necessary to locate the fasteners behind the gutters to prevent them from becoming overheated. The present invention has overcome this problem.

The present invention makes use of a unique scheme for protecting the head of bolt 60 from overheating. In particular, referring now to FIG. 3, the bolt head is released in a cavity 79 formed by heat shield 80 which is disposed upon an inside surface of gutter 54. The heat shield limits the bolt heating flux and provides a first amount of thermal protection. Additionally, the bolt head is cooled by a portion of the carbureted gas mixture passing through an aperture 82 within gutter 54 which fluidly communicates the upstream gas mixture with the cavity 79. This aperture is preferably aligned with the upstream gas direction to capture as much of the gas flow dynamic head as possible.

Since the augmenter fuel injectors (not shown) are well upstream of the flameholders to caburet the gas mixture, it might be expected that such a combustible mixture would ignite as it flowed through aperture 82 and thus heat bolt 60. However, if the velocity of the flow between the bolt 60 and heat shield 80 is maintained at a value at least as great as the flame propagation velocity, the flame will be unable to propagate upstream to the bolt and the bolt will, instead, be effectively cooled. Thus, an arrangement has been provided which permits the rapid installation or removal of the flameholder since nut 66 can be held with a box wrench while the bolt 60 is driven with a speed wrench.

In order to maintain the proper orientation of link 68, lug 64 is positioned in close-fitting, generally elongated slot 84 on the reverse side of gutter 54 from heat shield 80, and generally aligned therewith (FIGS. 4 and 5). The lug, therefore, provides the means to orient the flameholder within the nozzle structure and, along with link 68 and bolt 60, provides the necessary structural connection between the flameholder and the rigid supporting structure.

Often, the flameholder diameter is larger than the exhaust nozzle diameter. In order that such a flameholder can be removed through the exhaust nozzle for rapid replacement, it is proposed to segment it. Referring now to FIGS. 3, 6 and 7, it can be seen that the circumferentially extending gutters 54 and 56 have been segmented along plane 86 which splits the flameholder in half. While only two segments are shown, it is clear that the flameholder may be split in as many segments as desirable in order to facilitate removal. FIGS. 6 and 7 show in detail the means for connecting the two halves of the flameholder. Referring to the outer gutter 54, it can be seen that adjacent segments are provided with cooperating flanges 88 which extend upstream from a point proximate the apex of the gutter in order that flow blockage pressure losses are minimized. These cooperating flanges are connected as by nut and bolt 90, for example. A single connector (nut and bolt) is used, again to minimize pressure losses. To prevent the two mating flanges 88 from rotating relative to each other about the single bolt, alignment pins 92 are used. The alignment pins extend between segments in the tangential direction and are received within appropriate cooperating holes in each segment. Obviously, a similar structure would appear for the inner gutter 56. Thus, according to the objects of the present invention, a flameholder apparatus has been provided which is easily removable and wherein the mounting structure is protected from the intense heat inside the gutters. Further, simple means are provided to remove the flameholder through a relatively small exhaust nozzle.

Additionally, a method of cooling a fastener, such as bolt 60, connecting a flameholder gutter 54 to a support member (i.e., mixer 30), has been provided. Such a method is seen to include the steps of recessing the fastener in a heat shield 80, disposed within the gutter, and then passing a portion of the combustible gas stream into the heat shield and over the fastener at a velocity at least as great as flame propagation velocity.

It will be obvious to one skilled in the art that certain changes can be made to the above-described invention without departing from the broad inventive concepts thereof. For example, the subject invention is not limited to engines incorporating mixers since the flameholder could be affixed to the nozzle casing which would provide the necessary structural support. Also, the specific fasteners and connectors discussed herein are merely illustrative of many alternatives which may be employed and still remain within the scope of the present invention. Further, the concept of cooling a fastener with a combustible gas mixture is not limited to afterburner flameholders, but may be employed equally effectively with any structure disposed within such an environment. It is intended that the appended claims cover these and all other variations in the present invention's broader inventive concepts.

Having thus described the invention, what is claimed as novel and desired to be secured by Letters Patent of the United States is:

1. A flameholder apparatus for disposition within a combustible gas stream comprising:

a gutter for holding a flame;

a heat shield disposed within said gutter and upon a surface thereof, said heat shield forming a cavity having a cooling aperture through said gutter in communication with, and generally aligned with, the upstream gas stream; and means for fastening said gutter to a support member, said fastening means being partially recessed within said heat shield cavity; wherein said fastening means is cooled by a portion of the gas stream passing through said cooling aperture; and the size of said cavity and the size of said cooling aperture are such that the velocity of the cooling portion passing between said fastening means and said heat shield is at least as great as the flame propagation velocity.

2. The flameholder apparatus as recited in claim 1 wherein said fastening means comprises a threaded bolt having a head recessed within said cavity.

3. The flameholder apparatus as recited in claim 1 wherein said gutter is generally annular.

4. The flameholder apparatus as recited in claim 3 wherein said gutter is segmented circumferentially.

5. The flameholder apparatus as recited in claim 4 further comprising pin means received within adjacent gutter segments to provide relative alignment thereof.

6. The flameholder apparatus as recited in claim 5 further comprising:

cooperating flanges formed upon adjacent gutter segments, said flanges extending generally upstream with respect to said combustible gas stream; and means for attaching adjacent flanges together.

7. In a method of cooling a fastener connecting a flameholder gutter to a support member, said fastener protruding into said gutter, the steps of:

recessing the fastener in a heat shield disposed within said gutter; and passing a combustible gas stream into the heat shield, and over the fastener at a velocity at least as great as the flame propagation velocity.

* * * * *